United States Patent [19]

Jacobs et al.

[11] Patent Number: 4,944,673

[45] Date of Patent: Jul. 31, 1990

[54] DRIER FOR A WEB OF MATERIAL

[75] Inventors: Thomas G. M. Jacobs, Boxmeer; Clemens J. M. De Vroome, Beugen, both of Netherlands

[73] Assignee: Stork Contiweb B.V., Netherlands

[21] Appl. No.: 303,485

[22] Filed: Jan. 27, 1989

[30] Foreign Application Priority Data

Jan. 29, 1988 [NL] Netherlands ..... 8800226

[51] Int. Cl.[5] ..... F27B 9/28

[52] U.S. Cl. ..... 432/59; 34/155; 432/72

[58] Field of Search ..... 34/216, 210, 155, 22, 34/23, 79; 432/72, 223, 59

[56] References Cited

U.S. PATENT DOCUMENTS 3,923,449 12/1975 Brock .
4,140,467 2/1979 Ellison et al. .
4,475,294 10/1984 Hendrick ..... 34/216

FOREIGN PATENT DOCUMENTS 22048 5/1972 Australia .
0066661 12/1982 European Pat. Off. .
0127697 12/1984 European Pat. Off. .
2412446 9/1975 Fed. Rep. of Germany .
2410800 6/1979 France .
2526139 11/1983 France .
WO84/01021 3/1984 PCT Int'l Appl. .
2059032 4/1981 United Kingdom .

*Primary Examiner*—Henry A. Bennet
*Attorney, Agent, or Firm*—Ostrolenk, Faber, Gerb & Soffen

[57] ABSTRACT

A drier for a web of material in particular for a offset printing machine, consisting of an housing with an inlet slot and an outlet slot for the web of material. The housing is provided with air nozzles which are fed via one or more fans with the atmosphere in the housing. The housing also have at least one heating appliance provided with a combustion unit for treating the atmosphere inside the housing. The interior of the housing is divided by a partition into a heating section and an evaporating section. The heating appliance is provided with an incinerating portion and part of the combustion gases is via an opening discharged to the heating section, while the remaining combustion gases are discharged into the outside air, and the atmosphere of the evaporating section is used as combustion air for the burner of the combustion unit.

9 Claims, 2 Drawing Sheets

DRIER FOR A WEB OF MATERIAL

BACKGROUND OF THE INVENTION

The present invention relates to a drier for a web of material, in particular for an offset printing machine, comprising an essentially closed housing with an inlet slot and an outlet slot for the web of material, while in the housing provision is made on either side of the web of material for air nozzles, which are fed via one or more of fans with the atmosphere in the housing, said housing also having at least one heating appliance provided with a combustion unit for heating the atmosphere inside the housing.

Such a drier is known, for example from German "Offenlegungsschrift" No. 2412446. In this known drier the combustion gases from the combustion unit are discharged to the outside via a heat exchanger, and the air circulating inside the housing is heated up by means of said heat exchanger. This known drier has a number of disadvantages, relating to the complex and expensive design, in which a large number of control valves are necessary, requiring expensive control and regulating devices. Besides, the heat exchanger takes up a large amount of space.

An object of the present invention is to provide a drier having a compact design and a high efficiency.

Another object of the invention is to provide a drier in which the exhaust gases can be discharged to the outside air without any problem.

DESCRIPTION OF THE INVENTION

The drier according to the invention is characterized in that

- the interior of the housing is divided by a partition into two sections through which the web of material passes in succession and, viewed in the direction of movement of the web of material, the first section constitutes a heating zone and the second section constitutes an evaporation zone for the web of material;
- each heating appliance comprising an incinerating portion for the combustion of the solvent vapour content, an intake for combustion air, which is in communication with the second section, a discharge opening in the incinerating portion for discharging at least part of the combustion gases into said first section, in order to warm the atmosphere in said section;
- an opening in the partition for passing air from the first section to the second section for heating the second section.

The web of material arriving inside the first section of the drier has to be heated up in the first instance, before the actual evaporation commences. Since part of the combustion gases is fed directly into said first section, rapid and efficient heating of the atmosphere in said section takes place. The second section is heated up by air passing from the first section to the second section. Thus different temperatures, each adapted to the particular purpose, can be applied in the two sections. Since the evaporation takes place largely in the second section, virtually no oily or solvent vapours will be present in the first section. This means that hot combustion gases can be conveyed directly into this section, without the risk of harmful cracking products arising. So the first section can easily be kept at a higher temperature, which is necessary for rapid heating of the web of material, so that the drier can be made shorter and thus takes up less space.

The atmosphere in the second section will contain a high solvent vapour content because the evaporation will substantially take place in this section. It is therefore advantageous to use the atmosphere of the second section as combustion air for the burner unit. The oily or solvent vapours will thus be burnt in the incineration portion and the combustion gases which are not used for heating up the first section are clean enough to be discharged to the outside without any subsequent treatment.

A saving in energy can also be achieved according to the invention by discharging the combustion gases via a heat exchanger for heating up the combustion air. The combustion gases from the combustion unit are in this way cooled before they are discharged into the outside air.

The second section can be provided according to the invention with an additional inlet for outside air. Apart from the uncontrolled infeed of outside air via the inlet and outlet slot for the web of material, additional outside air can be fed into the second section of the drier in order to control the temperature inside said section and to keep the oxygen content of the air in this section up to the mark, for the purpose of ensuring good working of the burner. The invention is explained in greater detail with reference to the drawing, in which:

BRIEF DESCRIPTION OF THE DRAWINGS

FIG. 1 shows schematically a lengthwise section of the drier according to the invention.

DESCRIPTION OF THE PREFERRED EMBODIMENT

Figure 7:
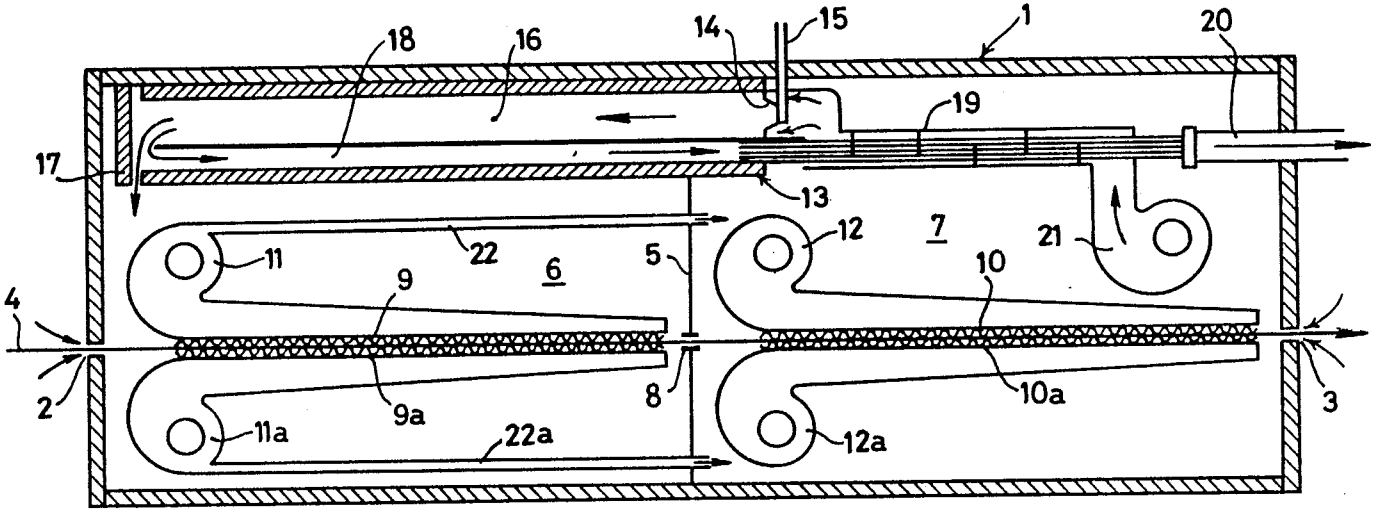

As can be seen in particular from FIG. 1, the drier according to the invention comprises an essentially closed housing 1 with an inlet slot 2 and an outlet slot 3 for a web of material 4 being fed through the drier. The web of material 4 comes, for example, from an offset printing machine, and good drying of said web 4 is vitally important for the final printing quality.

The interior of the housing is divided by a partition 5 into two sections 6 and 7, which are passed through in succession by the web of material 4, the first section 6 being a heating zone and the second section 7 being an evaporation zone for the web 4. The wall 5 here is provided with a slot 8 to allow passage of the web of material. The two sections 6 and 7 are each provided on either side of the web of material with nozzles 9, **9*a* and 10, 10*a*, each of which is fed by a fan 11, 11*a* and 12, 12*a* respectively. By means of these fans with nozzles, circulation of the atmosphere in that particular section occurs in each section, the web of material 4** being conveyed in a suspended state between the nozzles.

Provision is also made inside the housing for a heating appliance 13, which is provided with a combustion unit having a burner 14 with a gas supply line 15. The combustion unit has also an elongated combustion chamber 16, at the end of which there is an opening 17, through which part of the hot combustion gases can flow into the first section 6. The remaining part of the combustion gases is guided through the chamber 18, in which any harmful substances there may be are burnt. The clean combustion gases are discharged to the outside air through a heat exchanger 19 and then through a combustion gas outlet 20. The heat exchanger is also passed through by air discharged via a fan 21 from the second section, said air serving as combustion air for the combustion unit 14 and being heated by the heat exchanger 19.

The second section 7 is heated by air passing from the first section to the second section through openings in the partition 5, for instance through the slot 8 for the web 4.

The way in which the drier works will be explained partly with reference to FIG. 2, the same reference numbers as those in FIG. 1 being used.

Figure 2:
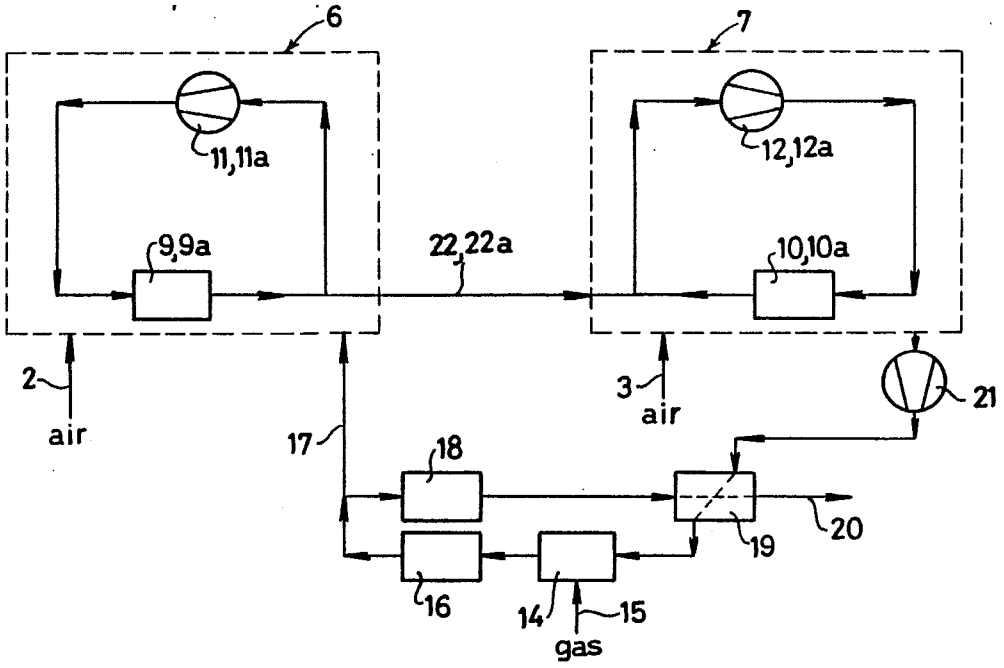
FIG. 2 is a block diagram showing how the drier of FIG. 2 works.

FIG. 2 shows only air and gas flows, and the web of material 4 is not shown in this figure.

The two sections 6 and 7 are indicated by dotted lines, and each section has air circulation via the fans 11, 11*a* and the nozzles 9, 9*a*, 12, 12*a* and 10, 10*a* respectively.

The first section 6, forming the heating zone, is heated by means of the combustion gases leaving the combustion chamber 16 via the opening 17. Virtually no evaporation will take place in this section, so that the air is relatively clean and the combustion gases from the combustion unit 16 can be fed indirectly without the risk arising of harmful cracking products being formed.

The second section 7, constituting the evaporation zone, is indirectly heated via the first section, through the fact that the air is conveyed from the first section 6 to the second section 7, for example via the slot 8. In the second section 7 the temperature is considerably lower than in the first section 6. The actual evaporation (drying) of the oily printing ink present on the web of material takes place in the section 7. The atmosphere in the section 7 thus has a relatively high concentration of oily vapours. The atmosphere from this section is fed as combustion air via the fan 21 via the heat exchanger 19 to the burner 14.

The gas supply to the burner 14 can be regulated by, for example, the temperature of the combustion gases going via the opening 17 into the first section 6. The remaining part of the combustion gases flows through the chamber 18 and, through the longer residence time, all harmful substances present in these combustion gases are burnt in this chamber, and these combustion gases can be discharged without any problem to the outside air via the heat exchanger 19.

In order to prevent leakage to the outside of the air present in the drier, there is a vacuum inside the drier, which has the result that fresh outside air flows in both at the inlet slot 2 and at the outlet slot 3 for the web of material.

In the second section 7 any additional outside air can be fed in, with the result that the temperature inside this section can be regulated and the oxygen content of the air present in the section 7 can also be kept up to the mark, in order to ensure that the burner unit 14 works properly. The first section could also be provided with an additional infeed for outside air. The quantity of outside air fed in depends on the quantity of combustion gases discharged and the air flowing in through the slots 2 and 3.

The design according to the invention provides a very efficient and compact drier, through the fact that the heating of the web of material and the actual evaporation take place in separate sections. On the one hand, this gives the advantage that the air in the heating zone contains virtually no oily vapours, while the evaporation zone actually has a relatively high concentration of oily vapours.

During starting up of the drier it is desirable to bring the drier rapidly up to temperature. For this, one or more further burners can be provided in the heating zone, the combustion taking place freely in this space. This is possible because the air present in this zone contains virtually no oily vapours and no harmful cracking products can arise as a result of the hot combustion gases.

The compact structure of the drier containing the combustion unit with the heat exchanger connecting thereto also has the advantage that the combustion unit need not be well insulated from the inside of the drier and, like the heat exchanger, need not be made leakproof. Leakage of combustion gases inside the drier does not in fact have any harmful consequences. Both the combustion unit and the heat exchanger can be designed simply and cheaply through this non-leakproof construction.

It will be clear that a large number of modifications are possible within the scope of the invention. For example, part of the combustion gases can also be conveyed into the first section 6 downstream of the chamber 18, while the remaining part can be discharged to the outside air, directly or through the heat exchanger 19.

It is also possible to have two heating appliances of identical construction which are symmetrically arranged at either side of the web.

What is claimed is:

1. A drier for a web, said drier comprising:

an essentially closed housing, said housing including an inlet through which the web enters said housing and an outlet through which the web exits said housing;

a heating section for heating the web, said heating section being located within said housing;

an evaporating section for evaporating material from the web after the web is heated by said heating section, said evaporating section being located within said housing;

a partition for separating said evaporating section from said heating section so that substantially no evaporation occurs within said heating section, said partition including an opening for transferring air directly from said heating section to said evaporating section to maintain the temperature within said evaporating section at a first temperature; and a heating appliance, including:

(a) an incinerator for incinerating the evaporated material and for generating hot combustion gases;

(b) an intake for transferring the evaporated material from said evaporating section to said incinerator; and (c) a discharge opening for discharging at least a portion of the hot combustion gases to said heating section to maintain the temperature within said heating section at a second temperature which is greater than the first temperature.

2. The drier of claim 1, wherein said drier is adapted for use with an offset printing machine, the evaporated material including vaporized solvent.

3. The drier of claim 2, further comprising nozzles for directing the atmosphere within said housing toward the web, said nozzles being located on either side of the web, and a fan for feeding the atmosphere through said nozzles.

4. The drier of claim 3, wherein said inlet and said outlet include slots.

5. The drier of claim 4, further comprising a heat exchanger with a hot side and a cold side, means for transferring a second portion of the combustion gases through said hot side of said heat exchanger and means for transferring the vaporized solvent from said evaporating section through said cold side of said heat exchanger.

6. The drier of claim 5, further comprising a gas outlet through which the second portion of the combustion gases exits said housing after having been transferred through said heat exchanger.

7. The drier of claim 4, wherein said discharge opening of said heating appliance is positioned with respect to said incinerator such that full combustion of the vaporized solvent does not occur until after the combustion gases are transferred past said discharge opening.

8. The drier of claim 7, further comprising a gas outlet through which the combustion gases exit said housing, said gas outlet being spaced apart from said incinerator such that substantially all of the vaporized solvent is burned before the combustion gases exit through said gas outlet.

9. The drier of claim 4, wherein said evaporating section includes means for introducing air from outside of said housing into said evaporating section to regulate the temperature within said evaporating section.

* * * * *